US007220456B2

(12) United States Patent
Mehta et al.

(10) Patent No.: US 7,220,456 B2
(45) **Date of Patent: *May 22, 2007**

(54) PROCESS FOR THE SELECTIVE DEPOSITION OF PARTICULATE MATERIAL

(75) Inventors: Rajesh V. Mehta, Rochester, NY (US); Ramesh Jagannathan, Rochester, NY (US); Seshadri Jagannathan, Pittsford, NY (US); David J. Nelson, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 158 days.

This patent is subject to a terminal disclaimer.

(21) Appl. No.: 10/815,010

(22) Filed: Mar. 31, 2004

(65) Prior Publication Data

US 2005/0220994 A1 Oct. 6, 2005

(51) Int. Cl.
*B05D 5/00* (2006.01)

(52) U.S. Cl. ..... 427/421.1; 427/422; 427/426; 427/427.4; 427/180; 427/189; 427/190; 427/191; 427/195; 427/201; 427/458; 427/466; 427/475; 427/483; 427/485; 427/486; 210/634

(58) Field of Classification Search ..... 427/421.1, 427/422, 426, 427.4
See application file for complete search history.

(56) References Cited

U.S. PATENT DOCUMENTS 4,582,731 A * 4/1986 Smith ..... 427/427

(Continued)

FOREIGN PATENT DOCUMENTS

EP 370268 5/1990

(Continued)

OTHER PUBLICATIONS

Jean W. Tom et al; "Particle Formation With Supercritical Fluids-A Review"; Journal of Aerosol Science; vol. 22, No. 5, pp. 555-584; 1991.

(Continued)

*Primary Examiner*—Alain L. Bashore
(74) *Attorney, Agent, or Firm*—Andrew J. Anderson

(57) ABSTRACT

A process for the patterning of a desired substance on a surface includes: (i) charging a particle formation vessel with a compressed fluid; (ii) introducing into the particle formation vessel a first feed stream comprising a solvent and the desired substance dissolved therein and a second feed stream comprising the compressed fluid, wherein the desired substance is less soluble in the compressed fluid relative to its solubility in the solvent and the solvent is soluble in the compressed fluid, and wherein the first feed stream is dispersed in the compressed fluid, allowing extraction of the solvent into the compressed fluid and precipitation of particles of the desired substance; (iii) exhausting compressed fluid, solvent and the desired substance from the particle formation vessel at a rate substantially equal to a rate of addition of such components to the vessel in step (ii) through a restrictive passage to a lower pressure whereby the compressed fluid is transformed to a gaseous state, and wherein the restrictive passage includes a discharge device that produces a shaped beam of particles of the desired substance at a point beyond an outlet of the discharge device, where the fluid is in a gaseous state at a location before or beyond the outlet of the discharge device; and (iv) exposing a receiver surface to the shaped beam of particles of the desired substance and selectively depositing a pattern of particles on the receiver surface.

20 Claims, 8 Drawing Sheets

U.S. PATENT DOCUMENTS

| | | | | |
|---|---|---|---|---|
| 4,734,227 | A | 3/1988 | Smith | |
| 4,734,451 | A | 3/1988 | Smith | |
| 4,737,384 | A | 4/1988 | Murthy et al. | |
| 4,923,720 | A * | 5/1990 | Lee et al. | 427/422 |
| 4,970,093 | A | 11/1990 | Sievers et al. | |
| 5,415,897 | A | 5/1995 | Chang et al. | |
| 5,639,441 | A * | 6/1997 | Sievers et al. | 424/9.3 |
| 5,707,634 | A | 1/1998 | Schmitt | |
| 5,851,453 | A | 12/1998 | Hanna et al. | |
| 6,221,435 | B1 * | 4/2001 | Nielsen | 427/421.1 |
| 6,440,337 | B1 | 8/2002 | Hanna et al. | |
| 6,471,327 | B2 * | 10/2002 | Jagannathan et al. | 347/21 |
| 6,575,721 | B1 | 6/2003 | Daly et al. | |
| 6,858,166 | B2 * | 2/2005 | Saim et al. | 264/5 |
| 2002/0000681 | A1 | 1/2002 | Gupta et al. | |
| 2002/0015797 | A1 | 2/2002 | Hunt et al. | |
| 2003/0107614 | A1 | 6/2003 | Nelson et al. | |
| 2003/0132993 | A1 | 7/2003 | Sadasivan et al. | |
| 2003/0222019 | A1 * | 12/2003 | Fulton et al. | 210/634 |
| 2003/0227499 | A1 | 12/2003 | Sadasivan et al. | |
| 2003/0227502 | A1 | 12/2003 | Sadasivan et al. | |
| 2004/0063809 | A1 * | 4/2004 | Fu et al. | 523/160 |
| 2005/0218076 | A1 | 10/2005 | Mehta et al. | |
| 2005/0221018 | A1 | 10/2005 | Mehta et al. | |

FOREIGN PATENT DOCUMENTS

| | | |
|---|---|---|
| EP | 473424 | 3/1992 |
| EP | 520728 | 12/1992 |
| EP | 1236519 | 9/2002 |
| EP | 1329315 | 7/2003 |
| EP | 1391944 | 2/2004 |
| WO | 95/01221 | 1/1995 |
| WO | 96/00610 | 1/1996 |
| WO | 97/31691 | 9/1997 |
| WO | 02/058674 | 8/2002 |

OTHER PUBLICATIONS

John L. Fulton et al; "Thin Fluoropolymer Films And Nanoparticle Coatings From The Rapid Expansion Of Supercritical Carbon Dioxide Solutions With Electrostatic Collection"; Polymer 44; 2003; pp. 3627-3632.

B. Helfgen et al; "Simulation Of Particle Formation During The Rapid Expansion Of Supercritical Solutions"; vol. 32; pp. 295-319; 2001.

"Strategies For Particle Design Using Supercritical Fluid Technologies"; of Peter York; Pharmaceutical Science & Technology Today; vol. 2; No. 11; Nov. 1999; pp. 430-440.

"Supercritical Antisolvent Precipitation of Micro- And Nano-Particles"; of Ernesto Reverchon; Journal of Supercritical Fluids; vol. 15, 1999; pp. 1-21.

"Particle Design Using Supercritical Fluids: Literature And Patent Survey"; of Jennifer Jung et al; Journal of Supercritical Fluids; vol. 20; 2001; pp. 179-219.

"Finely-Divided Powders By Carrier Solution Injection Into A Near Or Supercritical Fluid"; of William J. Schmitt et al; AIChE Journal; vol. 41; No. 11; Nov. 1995; pp. 2476-2486.

"Current Issues Relating To Anti-solvent Micronisation Techniques And Their Extension To Industrial Scales"; of Russell Thiering et al; Journal of Supercritical Fluids; vol. 21; 2001; pp. 159-177.

* cited by examiner

PROCESS FOR THE SELECTIVE DEPOSITION OF PARTICULATE MATERIAL

FIELD OF THE INVENTION

This invention relates generally to deposition technologies, and more particularly, to a technology for delivering a shaped beam of functional materials that are precipitated as liquid or solid particles into a compressible fluid that is in a supercritical or liquid state and becomes gaseous at ambient conditions, to create a pattern or image onto a receiver.

BACKGROUND OF THE INVENTION

Deposition technologies are typically defined as technologies that deposit functional materials dissolved and/or dispersed in a fluid onto a receiver (also commonly known as substrate etc.). Technologies that use supercritical fluid solvents to create thin films are known. For example, R. D. Smith in U.S. Pat. No. 4,582,731, U.S. Pat. No. 4,734,227 and U.S. Pat. No. 4,734,451 discloses a method involving dissolution of a solid material into a supercritical fluid solution and then rapidly expanding the solution through a short orifice into a region of relatively low pressure to produce a molecular spray. This may be directed against a substrate to deposit a solid thin film thereon, or discharged into a collection chamber to collect a fine powder. By choosing appropriate geometry of the orifice, and maintenance of temperature, the method also allows making of ultra-thin fibers from polymers. This method is known as RESS (rapid expansion of supercritical solutions) in the art.

In general, a process is considered a RESS process when the functional material is dissolved or dispersed in a supercritical fluid or a mixture of supercritical fluid and a liquid solvent, or a mixture of a supercritical fluid and surfactant, or a combination of these, which is then rapidly expanded to cause simultaneous precipitation of the functional material. Tom, J. W. and Debenedetti, P. B. discuss RESS techniques in "Particle Formation with Supercritical Fluids—a Review," J. Aerosol. Sci. (1991) 22:555–584, and also their applications to inorganic, organic, pharmaceutical and polymeric materials. The RESS technique is useful to precipitate small particles of shock- sensitive solids, to produce intimate mixtures of amorphous materials, to form polymeric micro-spheres, and deposit thin films. One problem with RESS based thin film deposition technologies is that it is limited only to materials that are soluble in supercritical fluid. While it is known that co-solvents can improve the solubility of some materials, the class of materials that can be processed with RESS based thin film technologies is small. Another significant problem is that such technologies fundamentally rely on formation of functional material particles through sudden reduction of local pressure in the delivery system. While the reduced pressure reduces the solvent power of the supercritical fluid, and causes precipitation of the solute as fine particles, the control of the highly dynamic operative processes is inherently very difficult. When co-solvents are used in RESS, great care is required to prevent dissolution of the particles by condensing solvent in the nozzle or premature precipitation of particles and clogging in the nozzle. Helfgen et al., in "Simulation of particle formation during the rapid expansion of supercritical solutions", J. of Aerosol Science, 32, 295–319 (2001), discuss how the nucleation of particles upon supersonic free-jet expansion, and subsequent growth by coagulation at and beyond Mach disk; pose significant design challenges in controlling the particle characteristics. In addition, beyond the expansion device, the complex transonic flow of gaseous material must be managed such that the particles are deposited onto a surface and do not remain suspended. in the expanded gas. This is dependent not only on fluid velocities but also on particle characteristics. A third problem pertains to the use of RESS methods in manufacturing: it is well recognized that progress to a fully continuous RESS process is limited by depletion of the stock solution to be expanded. Thus, there is a need for a technology that permits improved control of particle characteristics so that uniform thin films can be deposited onto receiver surfaces continuously with compressed carrier fluids for a broader class of materials.

Fulton et al. in "Thin fluoropolymer films and nanoparticle coatings from the rapid expansion of supercritical carbon dioxide solutions with electrostatic collection", Polymer, 44, 3627–3632 (2003), describe a process that charges the homogeneously nucleated particle as they are formed with an electric field applied to the tip of the expansion nozzle. The charged particles are then forced to a solid surface in this field generating a uniform particle coating. This method, however, does not overcome the limitations of the RESS process, namely, control of particle characteristics, and its applicability is limited to only materials soluble in supercritical fluid or its co-solvent mixture.

Sievers et al. U.S. Pat. No. 4,970,093 disclose a process for depositing a film on a substrate by rapidly releasing the pressure of a supercritical reaction mixture to form a vapor or aerosol that is not supercritical. A chemical reaction is induced in the vapor or aerosol so that a film of the desired material resulting from the chemical reaction is deposited on the substrate surface. Alternatively, the supercritical fluid contains a dissolved first reagent, which is contacted with a gas containing a second reagent, which reacts with the first reagent to form particles of the desired material deposited as a film on the substrate. In either case, the method still relies on particle formation upon expansion and suffers from the limited control of particle characteristics and only a narrow class of materials are suitable for processing by this method.

Hunt et al. U.S. 2002/0015797 A1 describe a method for chemical vapor deposition using a very fine atomization or vaporization of a reagent containing liquid or liquid-like fluid near its supercritical temperature by releasing it into a region of lower pressure, where the resulting atomized or vaporized solution is entered into a flame or a plasma torch, and a powder is formed or a coating is deposited onto a substrate. In this particular RESS process, rapid depressurization of a supercritical fluid creates an aerosol of liquid droplets. While further extending the number of possible usable precursors, this method does not improve the prior art in terms of particle characteristic control as particle nucleation and growth processes interact with the energetic regions of the combustion flame or plasma in uncontrolled fashion.

Sievers et al. U.S. Pat. No. 5,639,441 describe an alternative RESS process and apparatus for forming fine particles of a desired substance upon expansion of a pressurized fluid, wherein the substance is first dissolved or suspended in a first fluid that is immiscible with the second fluid, which is then mixed with the second fluid that is preferably in its supercritical state, and the immiscible mixture is then reduced in pressure to form a gas-borne dispersion of liquid droplets. The method thus relies on atomization and coalescence of fluid droplets upon expansion, rather than nucleation and growth of solid particles in the supercritical fluid. It is essentially a RESS process. as it seeks to make liquid particles through rapid expansion of supercritical fluids. The dispersion then is dried or heated to facilitate reactions to occur at or near surfaces to form coatings or fine particles. Thus, particle formation in this process occurs well beyond the expansion region and occurs through mechanisms similar to those operative during conventional spray or film drying.

U.S. Pat. No. 4,737,384 to Murthy et al. describes a process for depositing a thin metal or polymer coating on a substrate by exposing the substrate at supercritical temperatures and pressures to a solution containing the metal or polymer in a solvent and reducing the pressure or temperature to sub-critical values to deposit a thin coating of the metal or polymer on the substrate. Since the process relies on particle and film formation upon the expansion of the supercritical solution, it is still a RESS process.

U.S. Pat. Nos. 4,923,720 and 6,221,435 disclose liquid coatings application process and apparatus in which supercritical fluids are used to reduce, to application consistency, viscous coatings compositions to allow for their application as liquid spray. The method comprises of a closed system and relies on decompressive atomization of liquid spray for the formation of a liquid coating. Once again, the method is a RESS process as it depends on rapid expansion of supercritical fluids to form liquid droplets.

U.S. Pat. No. 6,575,721 discloses system for continuous processing of powder coating compositions in which supercritical fluids are used to reduce, to application consistency, viscous coatings compositions to allow for their application at a lower temperature. While the method comprises of continuous processing, it still relies on rapid expansion of supercritical fluids to form liquid droplets that are spray dried, and thus, is a RESS process.

U.S. Pat. No. 6,471,327, incorporated herein by reference, discloses an apparatus and method of focusing a thermodynamically stable dispersion or solution of functional material in a compressed fluid from a pressurized reservoir onto a receiver. The compressed fluid may be in its supercritical state. The method does not offer a fully continuous steady state process as it is limited by the depletion of the dispersion or solution from the pressurized reservoir. Also, the formulation mixture in the pressurized reservoir is nominally at its thermodynamic equilibrium state during the deposition process. Nelson et al in US 20030107614A1, Nelson et al in US20030227502A1, Nelson et al in US20030132993A1, and Sadasivan et al in US20030227499A1, incorporated by reference, define various additions and further concepts for providing an apparatus and method for printing with a thermodynamically stable mixture of a fluid and marking material.

Thus, there is still a strong need for a compressed fluid based process that operates continuously, has improved control of particle formation for a broader class of materials than hitherto possible with RESS based processes, and can be used for delivering a shaped beam of functional materials to create a high-resolution pattern or image onto a receiver.

SUMMARY OF THE INVENTION

In accordance with one embodiment of the invention, a process for the patterning of a desired substance on a surface is disclosed, the process comprising of the following:

(i) charging a particle formation vessel, the temperature and pressure in which are controlled, with a compressed fluid;

(ii) introducing into the particle formation vessel at least a first feed stream comprising at least a solvent and the desired substance dissolved therein through a first feed stream introduction port and a second feed stream comprising the compressed fluid through a second feed stream introduction port, wherein the desired substance is less soluble in the compressed fluid relative to its solubility in the solvent and the solvent is soluble in the compressed fluid, and wherein the first feed stream is dispersed in the compressed fluid, allowing extraction of the solvent into the compressed fluid and precipitation of particles of the desired substance, (iii) exhausting compressed fluid, solvent and the desired substance from the particle formation vessel at a rate substantially equal to a rate of addition of such components to the vessel in step (ii) while maintaining temperature and pressure in the vessel at a desired constant level, such that formation of particulate material in the vessel occurs under essentially steady-state conditions, wherein the compressed fluid, solvent and the desired substance are exhausted through a restrictive passage to a lower pressure whereby the compressed fluid is transformed to a gaseous state, and wherein the restrictive passage includes a discharge device that produces a shaped beam of particles of the desired substance at a point beyond an outlet of the discharge device, where the fluid is in a gaseous state at a location before or beyond the outlet of the discharge device; and (iv) exposing a receiver surface to the shaped beam of particles of the desired substance and selectively depositing a pattern of particles on the receiver surface.

In accordance with various embodiments, the present invention provides technologies that permit functional material deposition of ultra-small particles; that permit high speed, accurate, and precise deposition of a functional material on a receiver; that permits high speed, accurate, and precise patterning of ultra-small features on the receiver; that provide a self-energized, self-cleaning technology capable of controlled functional material deposition in a format that is free from receiver size restrictions; that permits high speed, accurate, and precise patterning of a receiver that can be used to create high resolution patterns on the receiver; that permits high speed, accurate, and precise patterning of a receiver having reduced functional material agglomeration characteristics; that permits high speed, accurate, and precise patterning of a receiver using a mixture of nanometer sized functional material dispersed in dense fluid; that permits high speed, accurate, and precise patterning of a receiver using a mixture of one or more nanometer sized functional materials dispersed in dense fluid and where the nanometer sized functional materials are created by precipitation under steady state conditions; that permits high speed, accurate, and precise patterning of a receiver using a mixture of nanometer sized one or more functional material dispersed in dense fluid and where the nanometer sized functional materials are created as a dispersion in a dense fluid under steady state conditions in a vessel containing a mixing device or devices; that permits high speed, accurate, and precise patterning of a receiver that has improved material deposition capabilities; that provide a more efficient printing method without the previous limitations on the amount of functional material that could be used due to solubility in the compressed fluid; and that permit the use of very small orifice size printhead nozzles without the need for filtration by ensuring that the functional material particles are all of a size range not to exceed 2 microns.

In accordance with preferred embodiments of the invention, the restrictive passage employed in the above various embodiments may include a partial-expansion chamber before a printhead nozzle of a discharge device, the purpose of which is to partially decrease the pressure of the compressed fluid, solvent and the desired substance exhausted from the particle formation vessel to a lower value prior to passage through the nozzle to allow for a lower pressure drop through and reduced velocity of functional materials exiting the nozzle, where the lower pressure value is determined by the appropriate application. These are novel features enabled by various embodiments of the present invention that are impossible in a RESS process. During the -expansion into the partial-expansion chamber and or a direct discharge process, other forces such as fluid, electrical, magnetic and/or electromagnetic in nature, may modify the fluid mixture.

BRIEF DESCRIPTION OF THE DRAWINGS

In the detailed description of the preferred embodiments of the invention presented below, reference is made to the accompanying drawings, in which.

DETAILED DESCRIPTION OF THE INVENTION

The present description will be directed in particular to elements forming part of, or cooperating more directly with, apparatus which may be employed in accordance with the present invention. It is to be understood that elements not specifically shown or described may take various forms well known to those skilled in the art. Additionally, materials identified as suitable for various facets of the invention, for example, functional materials, solvents, equipment, etc. are to be treated as exemplary, and are not intended to limit the scope of the invention in any manner.

Figure 1A:
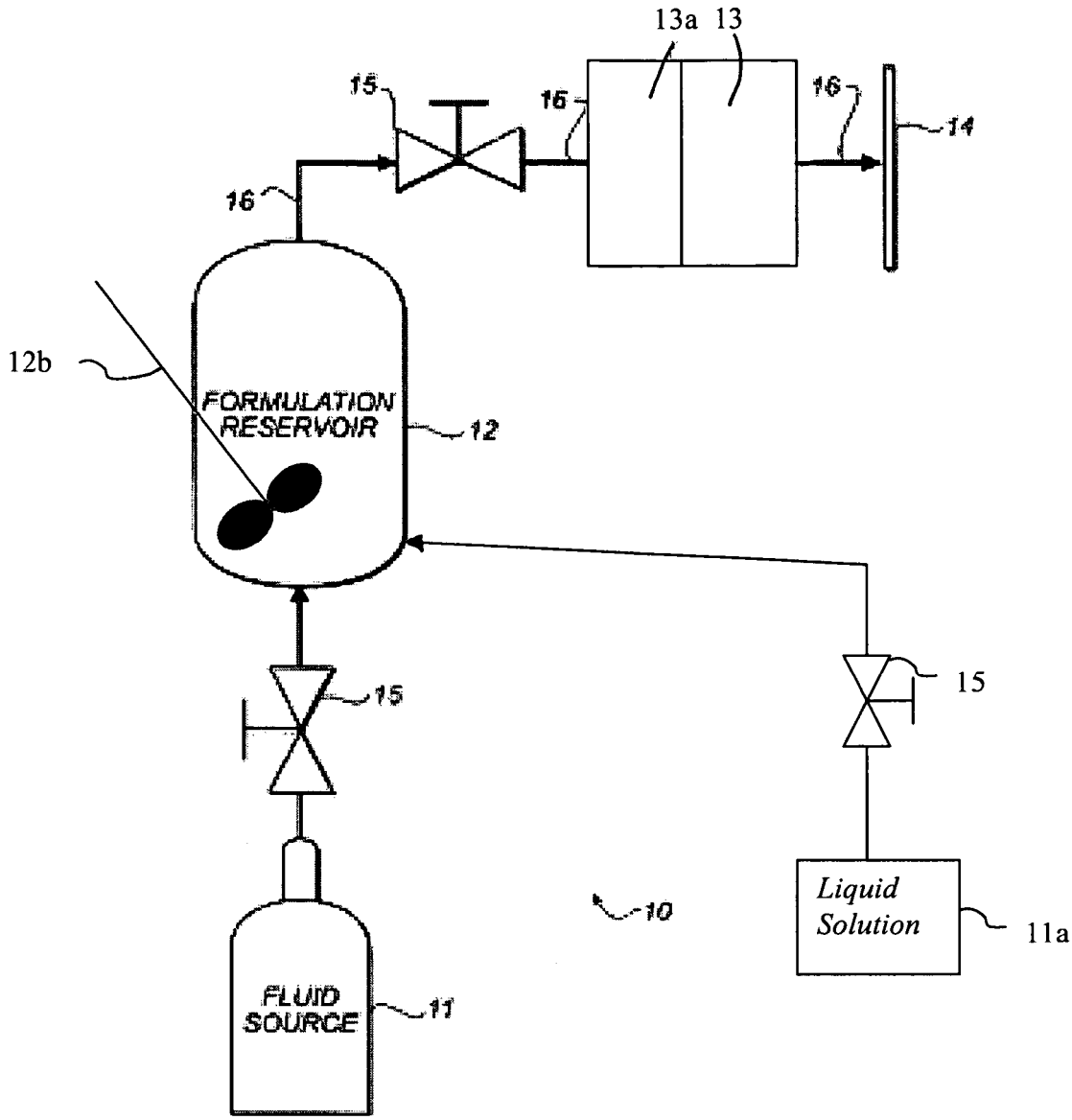
FIG. 1A is a schematic view of a preferred embodiment of a system which may be employed in accordance with the present invention.

In accordance with this invention, it has been found that particles of a desired substance can be prepared under essentially steady state conditions by precipitation of the desired substance from a solution upon contact with a compressed fluid antisolvent in a particle formation vessel under conditions as described herein, exhausted from the vessel through a restrictive passage which includes a discharge device shaped to produce a shaped beam of particles of the desired substance at a point beyond an outlet of the discharge device, and selectively deposited on a surface of a receiver to form a pattern of particles on the receiver. Referring to FIG. 1A, delivery system 10 in accordance with one embodiment of the invention has components, 11, 12, 13 and 11*a* that create a dispersion of an appropriate functional material or combination of functional materials in the chosen compressed liquid and/or supercritical fluid, and deliver the functional materials as a shaped beam onto a receiver 14 in a controlled manner. The delivery system 10 has a compressed fluid source 11, a source 11*a* containing one or more functional materials dissolved in a solvent, a particle formation vessel 12 containing a mixing device 12*b*, and a discharge device 13 connected in fluid communication along a delivery path 16. The delivery system 10 can also include a valve or valves 15 positioned along the delivery paths in order to control flow of the compressed fluid and solvent solutions. In a preferred embodiment, a partial-expansion chamber 13*a* may be employed in the delivery path prior to the discharge device 13, the purpose of which is described in further detail below. Though in FIG. 1A this partial-expansion chamber 13*a* is shown integral to the discharge device 13, this is not a requirement of the system. The optional partial-expansion chamber 13*a* may be a stand alone chamber in fluid communication with the discharge device and the remainder of the delivery system.

The process of the invention is applicable to the patterning of a wide variety of materials for use in, e.g., imaging (including photographic and printing, and in particular inkjet printing), electronics (including electronic display device applications, and in particular color filter arrays and organic light emitting diode display devices), data recording, and microstructure/nanostructure architecture building, all of which can benefit from use of small particulate material patterned deposition processes. Functional materials supplied by source 11*a* can be any material that needs to be delivered to a receiver in a patterned application, for example electroluminescent materials, imaging dyes, pigments, chemicals, pharmaceutically useful compounds, ceramic nanoparticles, protective agents, metal coating precursors, or other industrial substances whose desired form is that of a deposited pattern. Precipitated dyes and pigments are particularly preferred functional materials for use in patterned deposition applications in accordance with the invention. Materials of a desired substance precipitated and selectively deposited in accordance with the invention may be of the types such as organic, inorganic, metallo-organic, polymeric, oligomeric, metallic, alloy, ceramic, a synthetic and/or natural polymer, and a composite material of these previously mentioned. Such materials my be deposited for permanent deposition, etching, coating, other processes involving the patterned placement of a functional material on a receiver.

The desired material to be precipitated and deposited is first dissolved in a suitable liquid carrier solvent. The solvent used for the dissolution of the functional material(s) in source 11*a* can be either organic or inorganic in nature. As in known Supercritical Anti-Solvent (SAS) type processes, solvents for use in the present invention may be selected based on ability to dissolve the desired material, miscibility with a compressed fluid antisolvent, toxicity, cost, and other factors. The solvent/solute solution is then contacted with a compressed fluid antisolvent in a particle formation vessel, the temperature and pressure in which are controlled, where the compressed fluid is selected based on its solubility with the solvent and relative insolubility with the desired particulate material (compared to its solubility in the solvent), so as to initiate precipitation of the solute from the solvent upon rapid extraction of the solvent into the compressed fluid. The compressed fluid source 11 delivers the compressed fluid at predetermined conditions of pressure, temperature, and flow rate as a supercritical fluid, or a compressed liquid. Materials that are above their critical point, defined by a critical temperature and a critical pressure, are known as supercritical fluids. The critical temperature and critical pressure typically define a thermodynamic state in which a fluid or a material becomes supercritical and exhibits gas like and liquid like properties. Materials that are at sufficiently high temperatures and pressures below their critical point are known as compressed liquids.

The particle formation vessel 12 is utilized to dissolve and or chemically associate the solvent which is used to dissolve the functional material(s) with the compressed fluid in a rapid manner and subsequently precipitate the functional material(s) as fine particle dispersion in the compressed fluids/solvent mixture at desired formulation conditions of temperature, pressure, volume, concentration, molar flow rates the functional material(s) and compressed fluid and magnitude of the mixing intensity. Functional material to be deposited in accordance with the inventive method has relatively higher solubility in the carrier solvent than in the compressed fluid or than in the mixture of compressed fluid and the carrier solvent. This enables the creation of a high supersaturation zone in the vicinity of the introduction point where the solution of functional material in the carrier solvent is added into the particle formation vessel. Compressed fluids are defined in the context of this application as those fluids that have a density of greater than 0.1 grams per cubic centimeter in the range of temperature and pressure of the formulation reservoir, and which are gases at ambient temperature and pressure. Ambient conditions are preferably defined as temperature in the range from −100 to +100° C., and pressure in the range from $1\times10^{-8}$–100 atm for this application. Materials in their compressed fluid state that exist as gases at ambient conditions find application here because of their unique ability to act as antisolvents and precipitate functional materials of interest when in the compressed fluid state, and separate from the precipitated material when exhausted to ambient conditions. A wide variety of compressed fluids known in the art, and in particular supercritical fluids (e.g., $CO_2$, $NH_3$, $H_2O$, $N_2O$, xenon, ethane, ethylene, propane, propylene, butane, isobutane, chlorotrifluoromethane, monofluoromethane, sulphur hexafluoride and mixtures thereof, etc.), may be considered in such a selection, with supercritical $CO_2$ being generally preferred due its characteristics, e.g. low cost, wide availability, etc. Similarly, a wide variety of commonly used carrier solvents (e.g., ethanol, methanol, water, methylene chloride, acetone, toluene, dimethyl formamide, tetrahydrofuran, etc.) may be considered. Since, eventually both the compressed fluid and the carrier solvent are intended to be in the gaseous state, carrier solvents with higher volatility at lower temperatures are more desired. Additionally, any suitable surfactant and/or dispersant material that is capable of dispersing the functional materials in the compressed fluid for a specific application can be incorporated into the mixture of functional material and compressed liquid/supercritical fluid. The relative solubility of functional material can also be adjusted by appropriate choice of pressure and temperature in the particle formation vessel.

Another requirement of the inventive process is that feed materials are adequately mixed with the vessel 12 contents upon their introduction into the vessel, such that the carrier solvent and desired substance contained therein are dispersed in the compressed fluid, allowing extraction of the-solvent into the compressed fluid and precipitation of particles of the desired substance. This mixing may be accomplished by the velocity of the flow at the introduction point, or through the impingement of feeds on to another or on a surface, or through provision of additional energy through a mixing device 12*b* such as a rotary mixer, or through ultrasonic vibration. It is important that the entire content of the particle formation vessel is maintained as close to a uniform concentration of particles as possible. The spatial zone of non-uniformity near the feed introduction should also be minimized. Inadequate mixing process may lead to an inferior control of particle characteristics. Thus, feed introduction into a region of high agitation, and the maintenance of a generally well-mixed bulk region is preferred.

In accordance with a preferred embodiment of the invention, the solvent/desired substance solution and compressed fluid antisolvent are contacted in a particle formation vessel by introducing feed streams of such components into a highly agitated zone of the particle formation vessel, such that the first solvent/solute feed stream is dispersed in the compressed fluid by action of a rotary agitator as described in concurrently filed, copending, commonly assigned U.S. Ser. No. 10/814,354 the disclosure of which is incorporated by reference herein. As described in such copending application, effective micro and meso mixing, and resulting intimate contact of the feed stream components, enabled by the introduction of the feed streams into the vessel within a distance of one impeller diameter from the surface of the impeller of the rotary agitator, enable precipitations of particles of the desired substance in the particle formation vessel with a volume-weighted average diameter of less than 100 nanometers, preferably less than 50 nanometers, and most preferably less than 10 nanometers. In addition, a narrow size-frequency distribution for the particles may be obtained. The measure of the volume-weighted size-frequency distribution, or coefficient of variation (mean diameter of the distribution divided by the standard deviation of the distribution), e.g., is typically 50% or less, with coefficients of variation of even less than 20% being enabled. The size-frequency distribution may therefore be monodisperse. Process conditions may be controlled in the particle formation vessel, and changed when desired, to vary particle size as desired. Preferred mixing apparatus which may be used in accordance with such embodiment includes rotary agitators of the type which have been previously disclosed for use in the photographic silver halide emulsion art for precipitating silver halide particles by reaction of simultaneously introduced silver and halide salt solution feed streams. Such rotary agitators may include, e.g., turbines, marine propellers, discs, and other mixing impellers known in the art (see, e.g., U.S. Pat. No. 3,415,650; U.S. Pat. No. 6,513,965, U.S. Pat. No. 6,422,736; U.S. Pat. No. 5,690,428, U.S. Pat. No. 5,334,359, U.S. Pat. No. 4,289,733; U.S. Pat. No. 5,096,690; U.S. Pat. No. 4,666,669, EP 1156875, WO-0160511).

While the specific configurations of the rotary agitators which may be employed in preferred embodiments of the invention may vary significantly, they preferably will each employ at least one impeller having a surface and a diameter, which impeller is effective in creating a highly agitated zone in the vicinity of the agitator. The term "highly agitated zone" describes a zone in the close proximity of the agitator within which a significant fraction of the power provided for mixing is dissipated by the material flow. Typically it is contained within a distance of one impeller diameter from a rotary impeller surface. Introduction of the compressed fluid antisolvent feed stream and solvent/solute feed stream into a particle formation vessel in close proximity to a rotary mixer, such that the feed streams are introduced into a relatively highly agitated zone created by the action of the rotary agitator provides for accomplishing meso-, micro-, and macro-mixing of the feed stream components to practically useful degrees. Depending on the processing fluid properties and the dynamic time scales of transfer or transformation processes associated with the particular compressed fluid, solvent and solute materials employed, the rotary agitator preferably employed may be selected to optimize meso-, micro-, and macro-mixing to varying practically useful degrees.

Mixing apparatus which may be employed in one particular embodiment of the invention includes mixing devices of the type disclosed in Research Disclosure, Vol. 382, February 1996, Item 38213. In such apparatus, means are provided for introducing feed streams from a remote source by conduits which terminate close to an adjacent inlet zone of the mixing device (less than one impeller diameter from the surface of the mixer impeller). To facilitate mixing of the feed streams, they are introduced in opposing direction in the vicinity of the inlet zone of the mixing device. The mixing device is vertically disposed in a reaction vessel, and attached to the end of a shaft driven at high speed by a suitable means, such as a motor. The lower end of the rotating mixing device is spaced up from the bottom of the reaction vessel, but beneath the surface of the fluid contained within the vessel. Baffles, sufficient in number of inhibit horizontal rotation of the contents of the vessel, may be located around the mixing device. Such mixing devices are also schematically depicted in U.S. Pat. Nos. 5,549,879 and 6,048,683, the disclosures of which are incorporated by reference.

Mixing apparatus which may be employed in another embodiment of the invention includes mixers which facilitate separate control of feed stream dispersion (micromixing and mesomixing) and bulk circulation in the precipitation reactor (macromixing), such as described in U.S. Pat. No. 6,422,736, the disclosure of which is incorporated by reference. Such apparatus comprises a vertically oriented draft tube, a bottom impeller positioned in the draft tube, and a top impeller positioned in the draft tube above the first impeller and spaced therefrom a distance sufficient for independent operation. The bottom impeller is preferably a flat blade turbine (FBT) and is used to efficiently disperse the feed streams, which are added at the bottom of the draft tube. The top impeller is preferably a pitched blade turbine (PBT) and is used to circulate the bulk fluid through the draft tube in an upward direction providing a narrow circulation time distribution through the reaction zone. Appropriate baffling may be used. The two impellers are placed at a distance such that independent operation is obtained. This independent operation and the simplicity of its geometry are features that make this mixer well suited in the scale-up of precipitation processes. Such apparatus provides intense micromixing, that is, it provides very high power dissipation in the region of feed stream introduction.

Rapid dispersal of the feed streams is important in controlling several factors, such as supersaturation caused by mixing of the solvent/solute with the compressed fluid antisolvent. The more intense the turbulent mixing is in the feed zone, the more rapidly the feed will be dissipated and mixed with the bulk. This is preferably accomplished using a flat bladed impeller and feeding the reagents directly into the discharge zone of the impeller. The flat bladed impeller possesses high shear and dissipation characteristics using the simplest design possible. The apparatus as described in U.S. Pat. No. 6,422,736 also provides superior bulk circulation, or macromixing. Rapid homogenization rates and narrow circulation time distributions are desirable in achieving process uniformity. This is accomplished by employing an axial upward directed flow field, which is further enhanced by the use of a draft tube. This type of flow provides a single continuous circulation loop with no dead zones. In addition to directing fluid motion in an axial direction, the draft tube provides the means to run the impeller at much higher rpm, and confines the precipitation zone to the intensely mixed interior of the tube. To further stabilize the flow field, a disrupter device may be attached to the discharge of the draft tube, to reduce the rotational component of flow.

The use of a mixing device of the type described in U.S. Pat. No. 6,422,736 also provides a means for easily changing the power dissipation independently from the bulk circulation. This allows flexibility in choosing the mixing conditions that are optimal for the particular materials being used. This separation of bulk and hot zone mixing is accomplished by locating the pitched bladed impeller near the exit of the draft tube. The pitch bladed impeller provides a high flow to power ratio, which is easily varied, and is a simple design. It controls the rate of circulation through the draft tube, the rate being a function of the pitch angle of the blades, number and size of blades, etc. Because the pitch bladed impeller dissipates much less power than the flat bladed impeller, and is located sufficiently away from the feed point, the pitch bladed impeller does not interfere with the intensity of hot zone mixing in the draft tube, just the circulation rate through it. By placing the impellers a certain distance apart, this effect of independent mixing is maximized. The distance between the impellers also strongly affects the degree of back mixing in the hot zone, and hence provides yet another mixing parameter that can be varied. To further enable independent control of mixing parameters, the upper and lower impellers can have different diameters or operate at different speeds rather than the same speed. Also, the feed streams can be introduced by a multitude of tubes at various locations in the draft tube and with various orifice designs.

Another feature of the inventive process is that particle formation should occur in the vicinity of the feed introduction points under essentially steady-state conditions. The physical characteristics of the formed particles, such as size, shape, crystallinity etc., may be suitably altered by the conditions that primarily determine the supersaturation level in the vicinity of the feed introduction points as well as in the remote regions of the vessel. A higher local supersaturation level near the feed introduction points would lead to smaller mean particle size. The relative residence times of the particles in these two regions of the vessel can also be employed to alter some of the characteristics of the particles. The absence of dead zones, and the high degree of meso and micro mixing facilitates obtaining nano-sized precipitated particles, as well as the monodisperse nature of the particle size frequency distribution.

Yet another feature of the inventive process is that the particles of functional material contained in the compressed fluid mixture are not harvested on a filter, either inside or immediately downstream of the particle formation vessel, as is generally done in conventional Supercritical Anti-Solvent (SAS) processes, but rather are exhausted from the particle formation vessel while it is maintained under steady state conditions, and then are passed through a discharge device 13, which produces a shaped beam of particles of the desired substance at a point beyond an outlet of the discharge device, where the fluid is in a gaseous state at a location before or beyond the outlet of the discharge device, to directly selectively deposit the desired substance on a receiver 14 in a desired pattern. In the conventional SAS process, the presence of a filter designed primarily to harvest most of the particles formed in the particle formation vessel either requires installation of multiple filter elements in parallel, which increases manufacturing complexity, or requires interruption of the process to replace the plugged filter element in case of a single filter. The present process has no such limitations, which is highly advantageous.

For the subsequent deposition of particles of functional material, use of electrostatic means such as charge injection or tribo-charging may also be employed prior to expansion. The possibility of tribo-charging of particles is a clear advantage in this process compared to a RESS based system. Similarly, use of electrostatic means such as induction or corona charging, or fluid mechanical means such as guiding sheath flow of secondary gas, is also envisioned to deflect and/or further focus the focused beam of particles emerging from the discharge device 13.

Figure 1B:
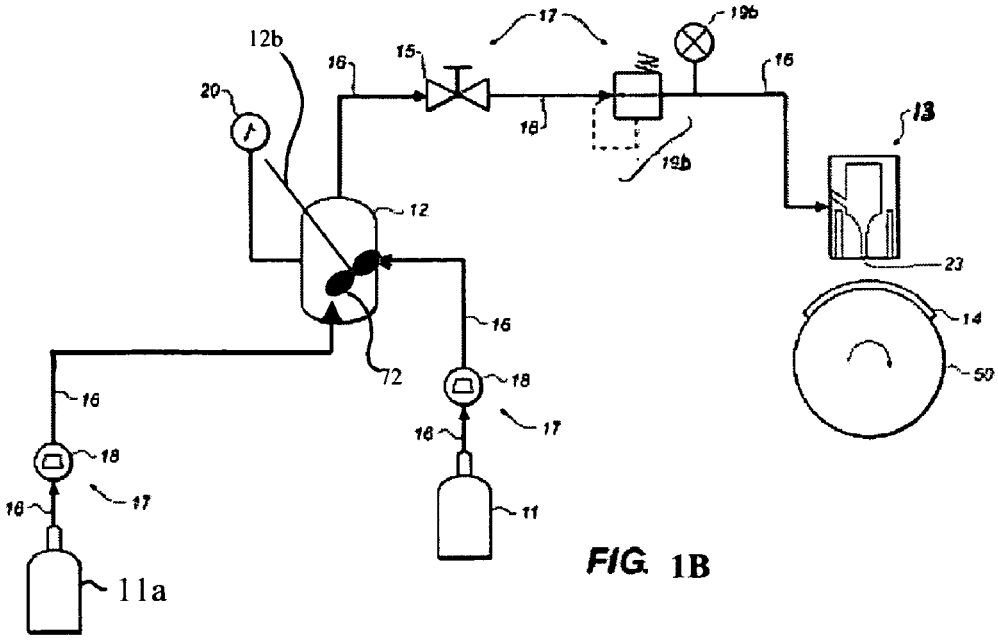
FIGS. 1B, 1F, 1G are schematic views of alternative embodiments of systems which may be employed in accordance with the present invention.

Referring to FIG. 1B, alternative embodiments of the invention shown in FIG. 1A are described. In each of these embodiments, individual components are in fluid communication, as is appropriate, along the delivery path 16. In FIG. 1B, a pressure control mechanism 17 is positioned along the delivery path 16. The pressure control mechanism 17 is used to create and maintain a desired pressure required for a particular application. The pressure control mechanism 17 can include a pump 18, a valve(s) 15, and a pressure regulator 19*b*, as shown in FIG. 1B. Additionally, the pressure control mechanism can include alternative combinations of pressure controlling devices, etc. For example, the pressure control mechanism 17 can include additional valve (s) 15, actuators to regulate fluid/formulation flow, variable volume devices to change system operating pressure, etc., appropriately positioned along the delivery path 16. Typically, the pump 18 is positioned along the delivery path 16 between the fluid source 11 and the particle formation vessel 12. The pump 18 can be a high-pressure pump that increases and maintains system operating pressure, etc. The pressure control mechanism 17 can also include any number of monitoring devices, gauges, etc., for monitoring the pressure of the delivery system 10.

A temperature control mechanism 20 is positioned along delivery path 16 in order to create and maintain a desired temperature for a particular application. The temperature control mechanism 20 is preferably positioned at the particle formation vessel 12. The temperature control mechanism 20 can include a heater, a heater including electrical wires, a water jacket, a refrigeration coil, a combination of temperature controlling devices, etc. The temperature control mechanism can also include any number of monitoring devices, gauges, etc., for monitoring the temperature of the delivery system 10. For example, as shown in FIGS. 4C–4J, the particle formation vessel 12 can include electrical heating/cooling zones 78, using electrical wires 80, electrical tapes, water jackets 82, other heating/cooling fluid jackets, refrigeration coils 84, etc., to control and maintain temperature. The temperature control mechanisms 20 can be positioned within the particle formation vessel 12 or positioned outside the particle formation vessel. Additionally, the temperature control mechanisms 20 can be positioned over a portion of the particle formation vessel 12, throughout the particle formation vessel 12, or over the entire area of the particle formation vessel 12.

The particle formation vessel 12 includes a mixing device 12*b* used to create the mixture of functional material and compressed liquid/supercritical fluid. The mixing device 12*b* can include a mixing element 72 connected to a power/control source to ensure that the functional material is precipitated and dispersed into associated mixture containing the solvent and the compressed fluid or supercritical fluid. The mixing element 72 can be, e.g., an acoustic, a mechanical, and/or an electromagnetic element.

Figure 4C:
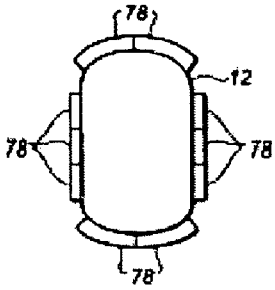
FIGS. 4C–4K are cross sectional views of a portion of the system shown in FIG. 1A.
Figure 4D:
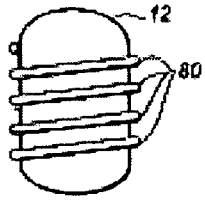
Figure 4E:
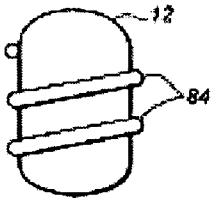
Figure 4F:
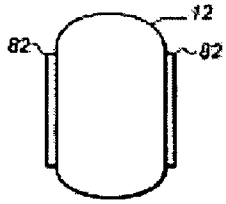
Figure 4G:
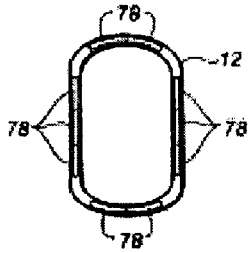
Figure 4H:
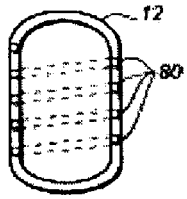
Figure 4I:
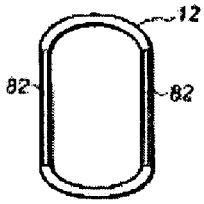
Figure 4J:
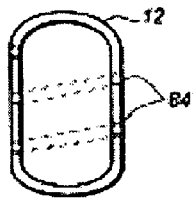
Figure 4K:
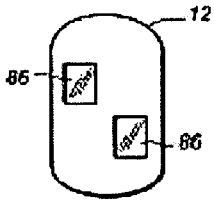

The particle formation vessel 12 can be made out of any suitable materials that can safely operate at the formulation conditions. An operating range from 0.001 atmosphere ($1.013\times10^{2}$ Pa) to 1000 atmospheres ($1.013\times10^{8}$ Pa) in pressure and from −25 degrees Centigrade to 1000 degrees Centigrade is generally preferred. Typically, the preferred materials include various grades of high-pressure stainless steel. However, it is possible to use other materials if the specific deposition or etching application dictates less extreme conditions of temperature and/or pressure. Referring to FIG. 4K, the particle formation vessel 12 can also include any number of suitable high-pressure windows 86 for manual viewing or digital viewing using an appropriate fiber optics or camera set-up. The windows 86 are typically made of sapphire or quartz or other suitable materials that permit the passage of the appropriate frequencies of radiation for viewing/detection/analysis of generator contents (using visible, infrared, X-ray etc. viewing/detection/analysis techniques), etc.

The discharge device 13 includes a nozzle 23 (shown in FIG. 1B) positioned to provide directed delivery of the formulation towards the receiver 14. As the mixture is under higher pressure, as compared to ambient conditions, in the delivery system 10, the mixture will naturally move toward the region of lower pressure, the area of ambient conditions. In this sense, the delivery system is said to be self-energized. As the mixture emerges from the discharge device 13, it leads to the transformation of supercritical fluid and the carrier solvent into their gas and vapor forms, while the functional material particles are entrained in the resultant focused flow stream. The receiver 14 can be positioned on a media conveyance mechanism 50 that is used to control the movement of the receiver during the operation of the delivery system 10.

Although an appropriately designed nozzle is necessary for the steady state operation of this process, its criticality is substantially different compared to a RESS process. This stems from the difference between managing a fluid stream that is undergoing a phase change (supercritical to non-supercritical) and precipitating the functional material (as in the case of RESS) and managing a fluid stream that is undergoing a phase change and is a dispersion of solid or liquid particles (as is the case for the inventive process). Thus, the formation of particles primarily in the particle formation vessel is an advantage of this process. As a result, the design of smaller diameter orifice nozzles is achievable without deleterious effects of plugging at the nozzle. An obvious advantage of achieving a smaller orifice nozzle is higher resolution printing. Many designs of nozzles are known in the art—such as capillary nozzles, or orifice plates, or porous plug restrictors. Variants having converging or diverging profile of the nozzle passages, or combinations thereof, are also known. In general, heated nozzles provide a more stable operating window than non-heated nozzles. Improved control of particle characteristics in the inventive process is also a key to a relatively plugging-free operation of these nozzles. Continuous particle formation processes enabled by the invention are also advantaged over RESS batch particle formation processes in that they generally require smaller particle formation vessels to be employed for practical applications.

Figure 2A:
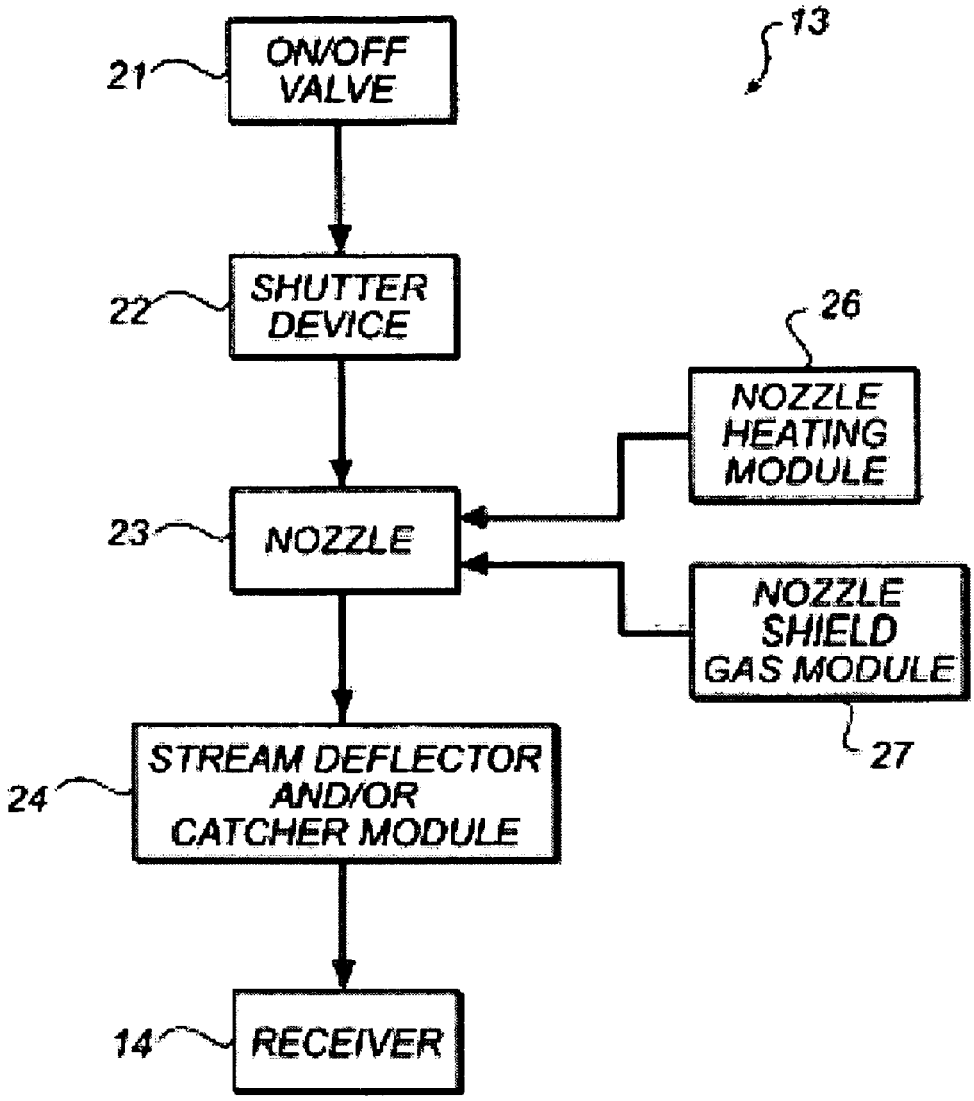
FIG. 2A is a block diagram of a discharge device which may be employed in accordance with the present invention.
Figure 2B:
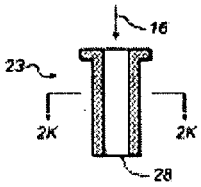
FIGS. 2B–2M are cross sectional views of a nozzle portion of the device shown in FIG. 2A.
Figure 2K:
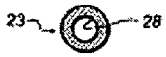
Figure 2E:
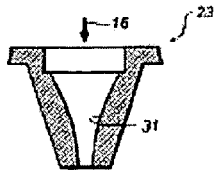
Figure 2F:
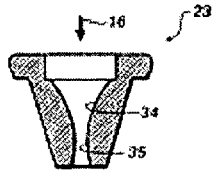
Figure 2C:
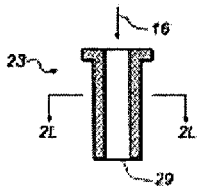
Figure 2L:
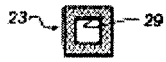

Referring to FIG. 2A, a discharge device 13 which may be employed in accordance with one embodiment is described in more detail. The discharge assembly includes a nozzle 23. The nozzle 23 can be provided, as necessary, with a nozzle heating module 26 and a nozzle shield gas module 27 to assist in beam collimation. The discharge device 13 also includes a stream deflector and/or catcher module 24 to assist in beam collimation prior to the beam reaching a receiver 25. Components 22–24, 26, and 27 of discharge device 13 are positioned relative to delivery path 16 such that the formulation continues along delivery path 16.

Alternatively, the shutter device 22 can be positioned after the nozzle heating module 26 and the nozzle shield gas module 27 or between the nozzle heating module 26 and the nozzle shield gas module 27. Alternatively, the shutter device 22 can be integrally formed within the nozzle 23. Additionally, the nozzle shield gas module 27 may not be required for certain applications, as is the case with the stream deflector and catcher module 24. Alternatively, discharge device 13 can include a stream deflector and catcher module 24 and not include the shutter device 22. In this situation, the stream deflector and catcher module 24 can be moveably positioned along delivery path 16 and used to regulate the flow of formulation such that a continuous flow of formulation exits while still allowing for discontinuous deposition and/or etching.

The nozzle 23 can be capable of translation in x, y, and z directions to permit suitable discontinuous and/or continuous functional material deposition and/or etching on the receiver 14. Translation of the nozzle can be achieved through manual, mechanical, pneumatic, electrical, electronic or computerized control mechanisms. Receiver 14 and/or media conveyance mechanism 50 can also be capable of translation in x, y, and z directions to permit suitable functional material deposition and/or etching on the receiver 14. Alternatively, both the receiver 14 and the nozzle 23 can be translatable in x, y, and z directions depending on the particular application. The media conveyance mechanism 50 can be a drum, an x, y, z translator, any other known media conveyance mechanism, etc. Examples of many such media conveyance mechanisms for use with a similar system are shown in Nelson et al in US 20030107614A1, Nelson et al in US20030227502A1, Nelson et al in US20030132993A1, Sadasivan et al in US20030227499A1.

Referring to FIGS. 2B–2M, the nozzle 23 functions to direct the formulation flow towards the receiver 14. It is also used to attenuate the final velocity with which the functional material impinges on the receiver 14. Accordingly, nozzle geometry can vary depending on a particular application. For example, nozzle geometry can be a constant area having a predetermined shape (cylinder 28, square 29, triangular 30, etc.) or variable area converging 31, variable area diverging 38, or variable area converging-diverging 32, with various forms of each available through altering the angles of convergence and/or divergence. Alternatively, a combination of a constant area with a variable area, for example, a converging-diverging nozzle with a tubular extension, etc., can be used. In addition, the nozzle 23 can be coaxial, axisymmetric, asymmetric, or any combination thereof (shown generally in 33). The shape 28, 29, 30, 31, 32, 33 of the nozzle 23 can assist in regulating the flow of the formulation. In a preferred embodiment of the present invention, the nozzle 23 includes a converging section or module 34, a throat section or module 35, and a diverging section or module 36. The throat section or module 35 of the nozzle 23 can have a straight section or module 37.

The teachings of U.S. Pat. No. 6,471,327, Nelson et al in US 20030107614A1, Nelson et al US20030227502A1, Nelson et al US20030132993A1, and Sadasivan et al US20030227499A1, incorporated by reference above, on printhead design, the use of multiple marking materials, cleaning and calibration, are additionally contemplated for use in the present invention to the extent they can be applied to the delivery of a shaped beam of functional materials that are precipitated as liquid or solid particles into a compressible fluid that is in a supercritical or liquid state and becomes gaseous at ambient conditions, to create a pattern or image onto a receiver. It should be emphasized, however, that since the current invention is based on particle formation in the particle formation vessel, it allows for significantly improved control of particle size and flowing characteristics. Consequently, some of the problematic nozzle shapes for RESS based applications may not be problematic to use for the inventive method. In particular, when the particle sizes are significantly smaller than the nozzle dimensions, a relatively plugging-free operation is envisioned. Thus, in preferred embodiments of the invention, use of nozzles in the sub-micron to 5 micron size range are advantageously enabled.

In accordance with the invention, passage of the compressed fluid, solvent and functional material from the particle formation vessel 12 to a lower pressure through a restrictive passage including a discharge device 13 leads to transformation of compressed fluid into a gaseous state at a location before or beyond the outlet of the discharge device (and the carrier solvent is preferably transformed into its vapor state), while the functional material particles are entrained in a resultant shaped beam. In accordance with preferred embodiments, as depicted in FIG. 1A, a partial-expansion chamber 13*a* may also be employed in flow path 16 prior to discharge device 13 to decrease the pressure from that of the particle formation vessel prior to discharge device 13. This pressure reduction can have many advantages in a printing system. As shown in U.S. Pat. No. 6,595,630 Jagannathan et al disclose a method and apparatus for controlling the depth of deposition of a solvent free functional material in a receiver. This method is somewhat limited by the RESS process in that the upstream of the nozzle conditions must be such that precipitation of the particles do not take place. As such, pressures upstream of the nozzle are fundamentally constrained in the design to be quite high. In the considered invention, this limitation is removed as the decrease in pressure in the partial-expansion chamber 13*a* can be such that the fluid in the partial-expansion chamber is in supercritical, liquid or vapor state. Preferably, however, the partial-expansion chamber is maintained at a temperature and pressure sufficient to maintain the solvent in a non-condensed state.

A partial-expansion chamber 13*a* can also be used to subject the fluid stream containing the precipitated particles to an external force field which are electrical, magnetic, sonic and any combination of those three forces. In U.S. Pat. No. 6,666,548 issued to Sadasivan et al, e.g., deflection of a stream of compressed fluid is shown. As means of clarification, the use of the word "continuous" by Sadasivan et al applies to the printing method wherein marking material is always being emitted from the nozzle rather than a drop on demand method. The Sadasivan invention is a RESS process and therefore not continuous with regards to an ability to deliver marking material in perpetuity. Deflection of the stream in U.S. Pat. No. 6,666,548 is achieved through electrostatic forces applied to a stream of charged particles. Unfortunately, very large voltages are required in this method because there is a limit to the amount that the particles can be pre-charged. The partial-expansion chamber. 13*a* obviates this limitation of the prior art by providing an environment to pre-charge the particles wherein they can be resident for a greater duration prior to passage through discharge device 13.

In addition, the use of a functional material solvent such as acetone in the process of the invention provides a compressed fluid with greater conductivity than that typically obtained in non-solvent containing compressed fluid processes. As such, the efficiency of charge injection processes in either the particle formulation vessel 12 or the partial-expansion chamber 13*a* may be greatly increased. Charged particles offer the ability for deflection as is the case in continuous printing systems or to enhance attachment to the receiver 14.

In pixellation systems with small nozzle orifice size (e.g., less than 10 micron), it may be desirable to maintain a high pressure in the formulation chamber 12 to facilitate the production of functional material particles of significantly small size at the nozzle. In addition, in such a system, it is desirable to limit the time of the final expansion to prevent particle agglomeration and subsequent nozzle 23 clogging. The combination of high pressures in the formulation chamber 12 and minimization of the expansion times result in conditions where a large expansion must occur in the system over a short time period. Such an expansion produces significant cooling due to the Joule-Thompson effect. As a result, undesirable conditions for coating and printing can result such as the solvent not fully evaporating during the final nozzle expansion due to temperatures. One solution to the above mentioned concern for solvent evaporation is to heat the final nozzle of the system to facilitate solvent evaporation. For pixellation or coating efficiency, it is desirable to maintain high mass flow rates of materials through the system. With this condition, and the short dwell time in the nozzle, pure nozzle heating may not provide enough heat to allow the solvent to evaporate before hitting the receiver 14. Another solution to the difficulties of ensuring that the solvent completely evaporates is to provide a partial-expansion chamber 13*a* in the system to step down the pressure before the final expansion as discussed above.

There are certain applications where having solvent in the final stream may be acceptable. In such applications, temperature controlled rollers or receiver holders can be used to some benefit in a heating mode (driving off the solvent), or a cooling mode (to condense the vapor on the substrate for efficient transfer of the functional material).

Figure 1F:
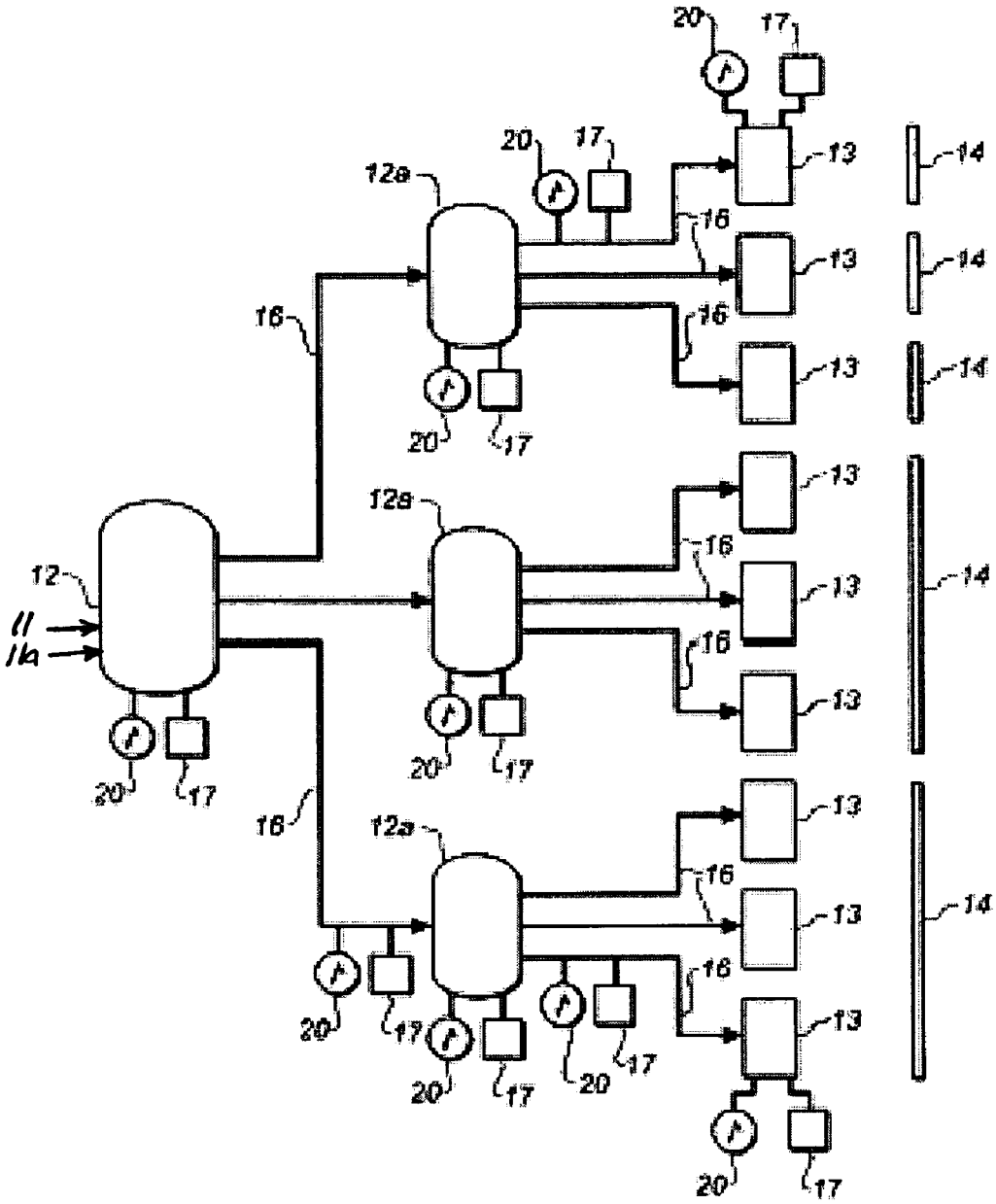

Referring to FIG. 1F, in an alternative arrangement, the mixture of functional material and compressed fluid can be continuously prepared in one particle formation vessel 12 and then continuously transported to one or more additional particle formation vessels 12*a*. For example, a single large particle formation vessel 12 can be suitably connected to one or more subsidiary high pressure vessels 12*a* that maintain the functional material and compressed liquid/supercritical fluid mixture at controlled temperature and pressure conditions with each subsidiary high pressure vessel 12*a* feeding one or more discharge devices 13. Either or both particle formation vessels 12 and 12*a* can be equipped with the temperature control mechanism 20 and/or pressure control mechanisms 17. The discharge devices 13 can direct the mixture towards a single receiver 14 or a plurality of receivers 14.

Figure 1G:
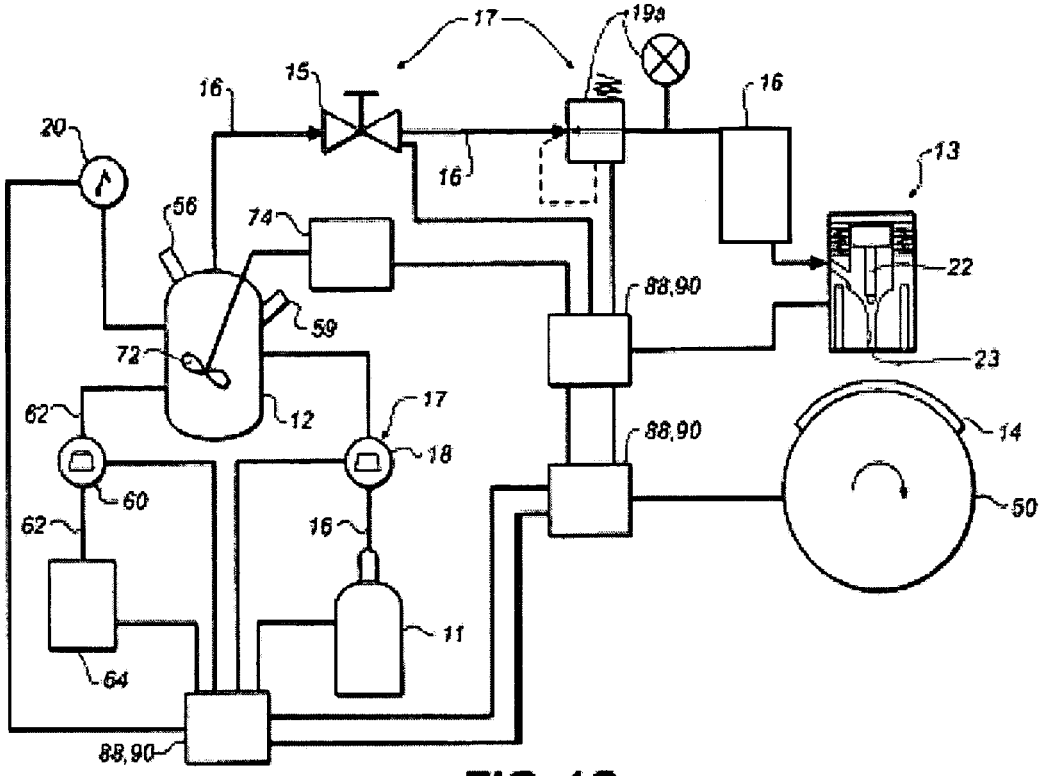

Referring to FIG. 1G, the delivery system 10 can include ports for the injection of suitable functional material, view cells, and suitable analytical equipment such as Fourier Transform Infrared Spectroscopy, Light Scattering, Ultraviolet or Visible Spectroscopy, etc. to permit monitoring of the delivery system 13 and the components of the delivery system. Additionally, the delivery system 10 can include any number of control devices 88, microprocessors 90, etc., used to control the delivery system 10.

Figure 3A:
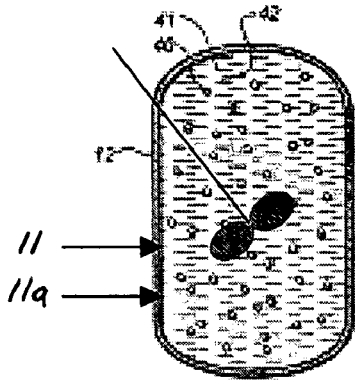
FIGS. 3A–3D are diagrams schematically representing the operation of embodiments of the present invention.
Figure 3B:
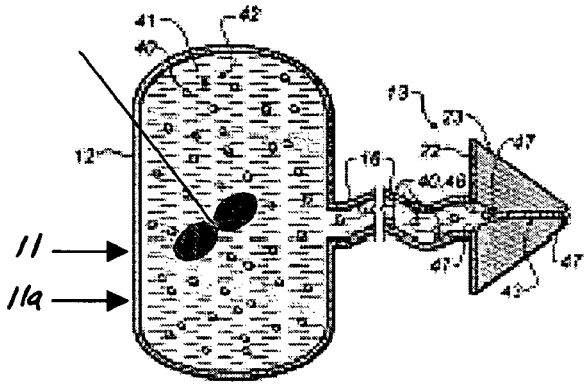
Figure 3C:
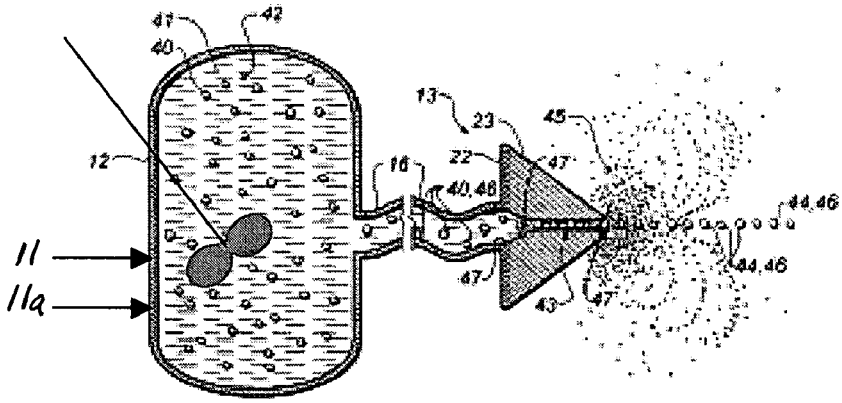
Figure 3D:
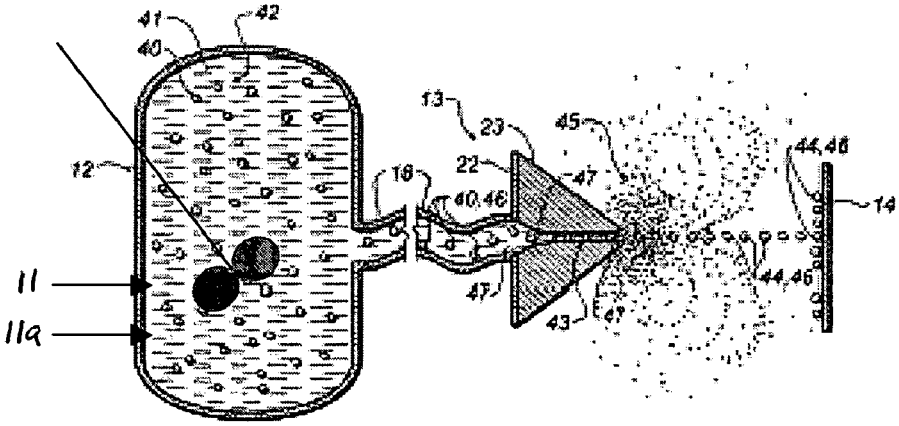

FIGS. 3A–3D are additional diagrams schematically representing the operation of various embodiments of delivery system 10 and should not be considered as limiting the scope of the invention in any manner. Compressed fluid and the solvent with functional material are controllably introduced into the particle formation vessel at specified molar addition rates. The contents of the particle formation vessel 12 are suitably mixed using mixing device 70 to ensure intimate contact between the functional material solution and compressed fluid and functional material is precipitated and dispersed (particles 40 as shown in FIG. 3A) in a continuous phase 41 comprising the compressed fluid and extracted solvent, making a mixture or formulation 42 that is continuously created under steady state conditions. The precipitated functional material 40 can have various shapes and sizes depending on the type of the functional material 40 used in the formulation. The formulation 42 (the functional material 40 and the associated mixture 41) is maintained at a suitable temperature and a suitable pressure for the functional material 40 and the associated mixture 41 used in a particular application. The functional material 40 can be a solid or a liquid. Additionally, the functional material 40 can be an organic molecule, a polymer molecule, a metallo-organic molecule, an inorganic molecule, an organic nanoparticle, a polymer nanoparticle, a metallo-organic nanoparticle, an inorganic nanoparticle, an organic microparticles, a polymer micro-particle, a metallo-organic microparticle, an inorganic microparticle, and/or composites of these materials, etc. The formulation 42 is controllably released from the particle formation vessel 12 through the discharge device 13. The shutter 22 is actuated to enable the ejection of a controlled quantity of the formulation 42. The nozzle 23 shapes the formulation 42 into a beam 43.

During the discharge process, which could include a partial-expansion chamber 13*a* as depicted in FIG IA, the dispersion of the functional material 40 in the associated mixture is converted to an aerosol mixture of the said functional material in a gas stream containing the gas of the compressed fluid and the vapor of the solvent in the associated mixture 41 as the temperature and/or pressure conditions change. The functional material 44 in the aerosol is directed towards a receiver 14 by the discharge device 13 as a shaped (e.g., focused and/or substantially collimated) beam. The aerosol mixture can be created either in a partial-expansion chamber 13*a,* in the transfer lines connected to the discharge device, at the discharge device or after the discharge device. The particle size of the functional material 44 deposited on the receiver 14 is typically in the range from 0.1 nanometers to 1000 nanometers. The particle size distribution may be controlled to be uniform by controlling the rate of change of temperature and/or pressure in the discharge device 13, the location of the receiver 14 relative to the discharge device 13, and the ambient conditions outside of the discharge device 13.

A partial-expansion chamber 13*a* permits the high pressures typically used to generate very small particles in the particle formation vessel 12 to be stepped down gradually in the continuous system and provides the opportunity to add heat more gradually than would be required without it. The practice of this invention is not limited to a single partial-expansion chamber. The use of several partial-expansion chambers to step down the pressure/add charge etc. may be advantageous. For practical engineering reasons, for example, o-ring maximum operating temperatures, it may not be possible to provide a high enough temperature in a single partial-expansion chamber to supply the formulation to the discharge device 13 in such a state that the solvent will fully evaporate.

As is well known, adding heat to a closed chamber will result in an increase in pressure. Therefore in the design of a partial-expansion process care must be taken to effectively balance the heat addition with the final pressure desired. For some applications, a limitation on the conditions in the last partial-expansion chamber 13*a* is that the compressed fluid be maintained in a supercritical condition. As previously discussed, for applications where solvent hitting the receiver 14 is undesirable it is preferred to provide temperature, pressure, flow rate, nozzle heating, and distance to the substrate to ensure that the solvent has the opportunity to completely evaporate. The design of a discharge device 13 to effectively shape the stream is highly dependent on the conditions of the final partial-expansion chamber, and as such, different discharge devices 13 may be required if the conditions in the final partial-expansion chamber 13*a* are significantly changed.

The delivery system 10 is also preferably designed to appropriately change the temperature and pressure of the particle dispersion to permit creation of an aerosol in a controlled manner so as to manage the size and size distribution of the particles of the functional material 40 comprising the aerosol. As the pressure is typically stepped down in stages, the dispersion 42 fluid flow is self-energized. Subsequent changes to the dispersion 42 conditions (a change in pressure, a change in temperature, etc.) results in the creation of the aerosol of the functional material 40 due to evaporation (shown generally at 45) of the compressed fluid and the solvent in the associated mixture 41. The particles of the functional material 44 deposits on the receiver 14 in a precise and accurate fashion. Evaporation 45 of the supercritical fluid and/or compressed liquid 41 and the solvent in the associated mixture can occur in a region located outside of the discharge device 13. Alternatively, evaporation 45 of the supercritical fluid and/or compressed liquid 41 and the solvent in the associated mixture can begin within in the partial-expansion chamber, in the discharge device 13 and continue in the region located outside the discharge device 13. Alternatively, evaporation 45 can occur within the discharge device 13.

A beam 43 (stream, etc.) of the functional material 40 and the associated mixture is formed as the dispersion 42 moves through the discharge device 13, and the discharge device forms a shaped beam 44 of discharged particles. To facilitate precise patterning, the discharge device preferably shapes beam 44 of discharged particles so that the majority of particles of the functional material are contained within a diverging cone having a cone angle of at most 90 degrees, more preferably so that the majority of particles are contained within a diverging cone having a cone angle of at most 45 degrees, and most preferably the beam shape is substantially collimated or even focused. A substantially collimated shaped beam occurs when the majority of the discharged functional material is maintained in a collimated beam with a diameter substantially equal to an exit diameter of the nozzle 23 of the discharge device 13. A focused beam occurs when the majority of discharged functional material is maintained in a converging stream where the stream diameter becomes less than the exit diameter of the nozzle 23 of the discharge device 13.

The distance of the receiver 14 from the discharge assembly and heating conditions are preferably chosen such that the associated mixture 41 substantially evaporates into gas phase (shown generally at 45) prior to reaching the receiver 14. Further, subsequent to the ejection of the dispersion 42 from the nozzle 23 and the creation of the functional material aerosol, additional focusing and/or collimation may be achieved using external devices such as electro-magnetic fields, mechanical shields, magnetic lenses, electrostatic lenses etc.

Alternatively, the receiver 14 can be electrically or electrostatically charged such that the position of the functional material 40 can be controlled.

It is also desirable to control the velocity with which individual particles 46 of the functional material 40 are ejected from the nozzle 23. Even with the addition of the partial-expansion chamber 13*a,* there is a sizable pressure drop from within the delivery system 10 to the operating environment, the pressure differential converts the potential energy of the delivery system 10 into kinetic energy that propels the functional material particles 46 onto the receiver 14. The velocity of these particles 46 can be controlled by altering the pressure within the partial-expansion chamber 13*a,* suitable nozzle design and control over the rate of change of operating pressure and temperature within the system. Further, subsequent to the ejection of the formulation 42 from the nozzle 23, additional velocity regulation of the functional material 40 may be achieved using external devices such as electromagnetic fields, mechanical shields, magnetic lenses, electrostatic lenses etc. Nozzle design and location relative to the receiver 14 also determine the pattern of functional material 40 deposition. The actual nozzle design will depend upon the particular application addressed.

Figure 2G:
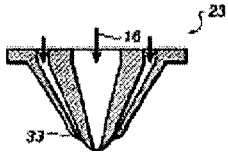
Figure 2H:
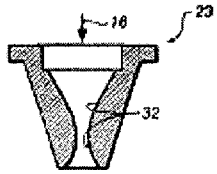
Figure 2D:
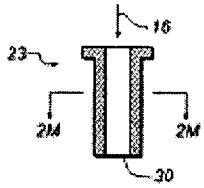
Figure 2M:
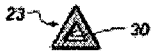
Figure 2I:
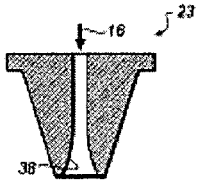
Figure 2J:
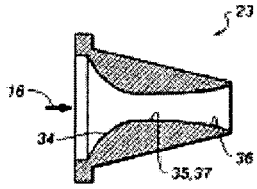

The nozzle 23 temperature can also be controlled. Nozzle temperature control may be controlled as required by specific applications to ensure that the nozzle opening 47 maintains the desired fluid flow characteristics. Nozzle temperature can be controlled through the nozzle heating module 26 using a water jacket, electrical heating techniques, etc. With appropriate nozzle design, the exiting stream temperature can be controlled at a desired value by enveloping the exiting stream with a co-current annular stream of a warm or cool, inert gas, as shown in FIG. 2G.

The receiver 14 can be any solid including an organic, an inorganic, a metallo-organic, a metallic, an alloy, a ceramic, a synthetic and/or natural polymeric, a gel, a glass, and a composite material. The receiver 14 can be porous or non-porous. Additionally, the receiver 14 can have more than one layer.

As indicated above, the process of the invention is in a preferred embodiment particularly appropriate for inkjet printing. Both drop on demand and continuous ink jet printing methods are enabled with the methods described in the invention. For continuous ink jet printing, as shown with a RESS process in U.S. Pat. No. 6,666,548 issued to Sadasivan et al, deflection of a stream of compressed fluid is used to create two different stream paths. On a pixel-by-pixel basis, one is used for printing on a substrate, the other is blocked. Drop on demand printing is commonly used today for liquids in which additional energy is applied to create drops where required. For the case of compressed fluids, systems to create a drop on demand style printer are disclosed in the previously mentioned patents issued to Nelson et al.

A continuous printing method is easily implemented in the current invention. In continuous printing, whether done with compressed fluids as disclosed by Sadasivan et al, differing drop sizes and an air flow as shown in Jeanmaire et al in U.S. Pat. No. 6,554,410, or electrostatic deflection as in the printheads sold by Kodak Versamark of Dayton Ohio, a constant amount of material is ejected from the printhead regardless of printing conditions. This fixed mass flow rate enables simplification of control schemes which may be used in the presently considered invention. The inputs to the particle formation vessel 12 can be controlled simply based on the known and constant flow rate of the discharge device 13, thus creating a steady state continuous process.

In the case of drop on demand printing, the condition of a constant flow rate through the printhead no longer exists. For example, the flow rate is now data dependent in that if an area of higher print density is required, the flow rate will increase. In such an instance it is not possible to maintain a system wherein the inputs to the particle formation vessel 12 are maintained constant. However, essentially steady state-conditions may be maintained in the particle formation vessel by controlling the inputs to the particle formation vessel 12 to match the varying flow rates through the printhead, e.g. in response to a measured parameter in the particle formation vessel 12, such as pressure, temperature, material concentrations, etc. Controllers capable of performing this function are commonly used in industry. In such a manner, a pseudo continuous process is achieved wherein the conditions within the system including the particle formation vessel 12, and optional pre-nozzle expansion chamber 13*a* are maintained essentially in a steady state condition, while the flow through the discharge device 13 can be varied.

The invention has been described in detail with particular reference to certain preferred embodiments thereof, but it will be understood that variations and modifications can be effected within the spirit and scope of the invention.

The invention claimed is:

1. A process for the patterning of a desired substance on a surface comprising:

(i) charging a particle formation vessel, the temperature and pressure in which are controlled, with a compressed fluid;

(ii) introducing into the particle formation vessel at least a first feed stream comprising at least a solvent and the desired substance dissolved therein through a first feed stream introduction port and a second feed stream comprising the compressed fluid through a second feed stream introduction port, wherein the desired substance is less soluble in the compressed fluid relative to its solubility in the solvent and the solvent is soluble in the compressed fluid, and wherein the first feed stream is dispersed in the compressed fluid, allowing extraction of the solvent into the compressed fluid and precipitation of particles of the desired substance, (iii) exhausting compressed fluid, solvent and the desired substance from the particle formation vessel at a rate substantially equal to a rate of addition of such components to the vessel in step (ii) while maintaining temperature and pressure in the vessel at a desired constant level, such that formation of particulate material in the vessel occurs under essentially steady-state conditions, wherein the compressed fluid, solvent and the desired substance are exhausted through a restrictive passage to a lower pressure whereby the compressed fluid is transformed to a gaseous state, and wherein the restrictive passage includes a discharge device that produces a shaped beam of particles of the desired substance at a point beyond an outlet of the discharge device, where the fluid is in a gaseous state at a location before or beyond the outlet of the discharge device; and (iv) exposing a receiver surface to the shaped beam of particles of the desired substance and selectively depositing a pattern of particles on the receiver surface.

2. A process according to claim 1, wherein the compressed fluid comprises a supercritical fluid.

3. A process according to claim 1, wherein the restrictive passage includes a partial-expansion chamber before the discharge device, in which the pressure of the compressed fluid, solvent and the desired substance exhausted from the particle formation vessel is decreased prior to passage through the discharge device.

4. A process according to claim 3, wherein the partial-expansion chamber is maintained at a temperature and pressure sufficient to maintain the solvent in a non-condensed state.

5. A process according to claim 3, wherein precipitated particles of the desired substance are subjected to an electrical, magnetic, or sonic force, or any combination of such forces, in the partial-expansion chamber.

6. A process according to claim 1, wherein particles of the desired substance are precipitating in the particle formation vessel with a volume-weighted average diameter of less than 100 nanometers.

7. A process according to claim 6, wherein the particles of the desired substance precipitated in the particle formation vessel have a particle size distribution with a coefficient of variation that is less than 50%.

8. A process according to claim 6, wherein the particles of the desired substance precipitated in the particle formation vessel have a particle size distribution with a coefficient of variation that is less than 20%.

9. A process according to claim 1, wherein particles of the desired substance are precipitating in the particle formation vessel with a volume-weighted average diameter of less than 50 nanometers.

10. A process according to claim 1, wherein particles of the desired substance are precipitating in the particle formation vessel with a volume-weighted average diameter of less than 10 nanometers.

11. A process according to claim 1, wherein the discharge device produces a shaped beam in which the majority of particles of the desired substance are contained within a diverging cone having a cone angle of at most 90 degrees at a point beyond an outlet of the discharge device.

12. A process according to claim 1, wherein the discharge device produces a shaped beam in which the majority of particles of the desired substance are contained within a diverging cone having a cone angle of at most 45 degrees at a point beyond an outlet of the discharge device.

13. A process according to claim 1, wherein the discharge device produces a substantially collimated or focused beam of particles of the desired substance at a point beyond an outlet of the discharge device.

14. A process according to claim 1, wherein contents of the particle formation vessel are agitated with a rotary agitator comprising an impeller having an impeller surface and an impeller diameter, creating a relatively highly agitated zone located within a distance of one impeller diameter from the surface of the impeller of the rotary agitator, and a bulk mixing zone located at distances greater than one impeller diameter from the surface of the impeller, and wherein the first and second feed stream introduction ports are located within a distance of one impeller diameter from the surface of the impeller of the rotary agitator such that the first and second feed streams are introduced into the highly agitated zone of the particle formation vessel and the first feed stream is dispersed in the compressed fluid by action of the rotary agitator.

15. A process according to claim 1, wherein the discharge device comprises a nozzle with an outlet opening of less than 5microns.

16. A process according to claim 1, wherein the discharge device comprises a nozzle with an outlet opening of less than 1 micron.

17. A process according to claim 1, where the desired substance deposited in step (iv) comprises a colorant in a polymeric binder.

18. A process according to claim 16, wherein the colorant comprises a dye.

19. A process according to claim 1, comprising a continuous ink jet printing process wherein the compressed fluid, solvent and the desired substance are exhausted through the restrictive passage at a known constant flow rate and input of materials to the particle formation vessel are controlled based on the known constant flow rate.

20. A process according to claim 1, comprising a drop on demand ink jet printing process wherein the compressed fluid, solvent and the desired substance are exhausted through the restrictive passage in a varying output flow rate and input of materials to the particle formation vessel are controlled to match the varying output flow rate.

* * * * *